US005782473A

United States Patent [19]

Chou et al.

[11] Patent Number: 5,782,473

[45] Date of Patent: Jul. 21, 1998

[54] METHOD OF PLAYING A BIG TEN CARD GAME

[76] Inventors: Henry H. Chou; Ian Y. Fu, both of 430 S. Garfield Ave. #315, Alhambra, Calif. 91801

[21] Appl. No.: 933,625

[22] Filed: Sep. 19, 1997

[51] Int. Cl.[6] ..... A63F 1/00

[52] U.S. Cl. ..... 273/292

[58] Field of Search ..... 273/292, 303, 273/305

[56] References Cited

U.S. PATENT DOCUMENTS

| | | | |
|---|---|---|---|
| 5,224,706 | 7/1993 | Bridgeman et al. | 273/292 X |
| 5,288,082 | 2/1994 | Marquez | 273/292 |
| 5,294,128 | 3/1994 | Marquez | 273/292 |
| 5,314,193 | 5/1994 | Ferrer | 273/292 |
| 5,395,120 | 3/1995 | Malek | 273/292 |
| 5,580,061 | 12/1996 | Kong | 273/292 |

*Primary Examiner*—William E. Stoll
*Attorney, Agent, or Firm*—David & Raymond; Raymond Y. Chan

[57] ABSTRACT

A method of playing a Big Ten card game which is operated between at least two players and is a five-card game with at least one deck of conventional 52 cards which includes four sets of cards. Each of the set of cards includes nine numerical value cards from 2 to 10, a Jack, a Queen, a King and an Ace. In this game, the Ace can be recognized or counted as either one or ten points, whereby the Jack, Queen and King are individually counted as ten points. To start, each player is dealt five cards each. After determining the points perceived on hand, each player must show three cards from his hand which add up to either ten, twenty, or thirty to continue playing the game. If a player cannot successfully do that, he is "disqualified" and must leave the game and wait for the next round. All players compare a comparison point value by summing up the point values of their remaining two playing cards with each other to determine the winner who has the highest comparison point value, wherein if the sum of the two playing card's total point value is larger than ten, the total point value is deducted by ten to achieve the comparison point value.

18 Claims, 1 Drawing Sheet

METHOD OF PLAYING A BIG TEN CARD GAME

BACKGROUND OF THE PRESENT INVENTION

The present invention relates to a card game for entertainment or casino, and more particularly to a method of playing a Big Ten card game which is a 5-card game using at least one deck of 52 cards, and commences with at least two players, wherein one of the players can be assigned the title of "House".

Numerous card games have existed where players are dealt a number of cards and then have an option of receiving additional cards. The object of such a game is to score a predetermined number of points without going over this predetermined number. A well-known game where the object is to reach a point value of twenty one without going over this limit is "Black-Jack".

Applicant is aware of several card games which generally can be played in a casino-type environment. U.S. Pat. No. 5,072,946 to Miller discloses a casino-type card game involving two players. A card is dealt to each player, and when the total numerical values of the cards are compared, a tie ends the game, or another card is dealt to the player with the lower numerical value hand. The player first reaching a predetermined numerical value eventually wins the game. Another patent, U.S. Pat. No. 5,275,415 to Wisted, discloses a "Black-Jack" type game among a plurality of players playing against each other with a player. The dealer, however, does not receive any cards. U.S. Pat. No. 5,265,882 to Malek discloses a casino-type card game wherein a player simultaneously plays at least two of three games against the player. This game is applicable to "Twenty-One", modified Draw Poker, and Baccarat. None of these games can compare to the uniqueness of the present invention.

SUMMARY OF THE PRESENT INVENTION

The main object of the present invention is to provide a method of playing a Big Ten card game which is easy to play, full of fun and excited. Accordingly, the Big Ten card game of the present invention is operated between at least two to a plurality of players, such as a game between a "House" and a several players or just simply between two players. The method of Big Ten card game is a five-card game using at least one deck of 52 cards, such as a poker deck. Each deck of cards includes four sets of cards and each set of cards includes an Ace, nine numerical value cards having a sequence of numerical values from 2 to 10, and three face cards including a Jack, a Queen and a King. The four sets of cards of each deck can also be identified by different face signs as a Spade group set, a Heart group set, a Club group set, and a Diamond group set.

In this game, the point value of each numerical value card is counted as its face numerical value. The Ace can be recognized or counted as either one or ten points. The Jack, Queen or King is respectively and individually counted as ten points. To start, the "House" and the players are dealt five cards each, and while the House's hand remains covered or hidden, each player must inspect their hand of cards in private manner to determine the number of points perceived on hand. After determining the points perceived on hand, each player must show three cards from his hand which add up to either ten, twenty, or thirty in order to be qualified to continue playing the game. If a player cannot successfully do that, he is "disqualified" and must leave the game and wait for the next round. The qualified players continue to play against the "House", in which the "House" shows all five cards in its hands, and if it does not have three cards which add up to either ten, twenty, or thirty, the House does not qualify and all qualified players win. If the House is qualified, each qualified player now discard the three cards which have been used for qualification and shows the remaining two cards, called playing cards. Finally, a comparison point value is achieved by the House and each qualified player by summing up the point values of their two playing cards if the total point of value of the two playing cards is equal to or less than ten. However, if the total point value is larger than ten, the total point value is deducted by ten to achieve the comparison point value. The House then compares its comparison point value in its hand against the comparison point value in the hand of each player, and the party with a higher comparison point value count wins.

If the House and a player have the same comparison point value, i.e. called Tie Hand, the higher number (point value) of the House's two playing cards is compared with the higher number (point value) of the player's two playing cards. The one having a higher numerical order wins the card game.

If both the higher ranking card of House and the player are face cards, the ranking order of the face is compared. The one who gets the higher face wins. The ACE has a high ranking order than the KING which has a higher ranking order than the QUEEN which has a higher ranking order than the JACK which has a higher ranking order than the "10".

Furthermore, if the higher number (point value) or the face sign of the two playing cards of the House and the player are the same face card, the face signs of the bigger number card of the two playing cards of the House and the player is compared. The one who has the higher ranking face sign is the winner, wherein Spade is higher than Heart which is higher than Club which is higher than Diamond.

Moreover, if any player has a hand of five cards with any combination among the face cards, the numerical value card having the numerical value of 10, and the Ace, that is whose total point value is fifty, it is qualified as Big Ten. Any player has a hand of Big Ten automatically win the game.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in reference with the accompanying drawing.

DETAILED DESCRIPTION OF THE PREFERRED EMBODIMENT

Figure 1:
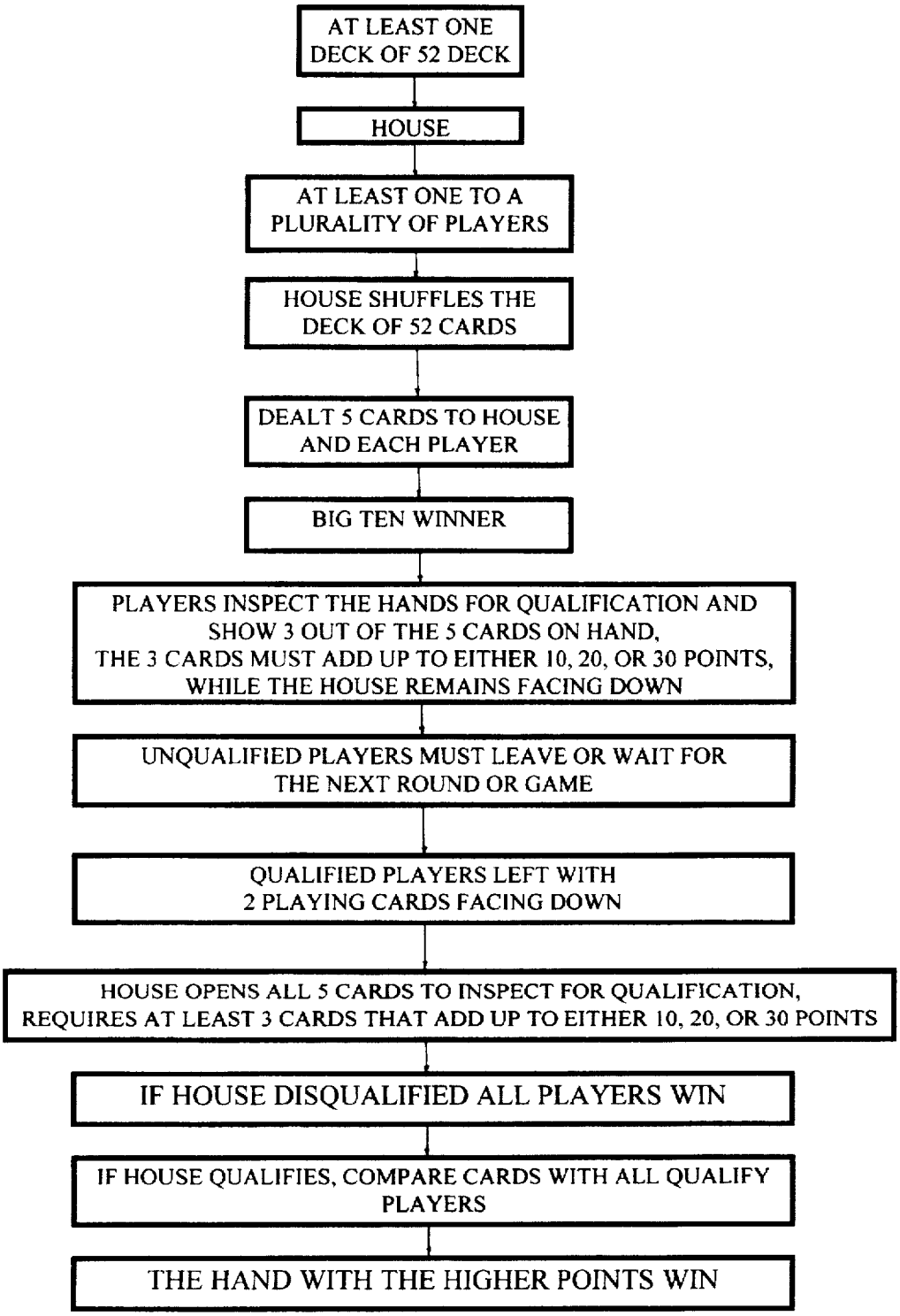
FIG. 1 is a flow-chart of a method of playing a big ten card game of a preferred embodiment according to the present invention, showing the steps and the process of the big ten card game.

Referring to FIG. 1, a descending order flow-chart of a preferred embodiment of the present invention is illustrated. A Big Ten card game for entertainment of casino is operated between at least two player and is a five-card game using at least one deck of 52 cards, such as a poker deck. Each deck of cards includes four sets of cards and each set of cards includes an ACE, three face cards including a JACK, a QUEEN and a KING, and nine numerical value cards having a sequence of numerical value from 2 to 10, i.e. 2, 3, 4, 5, 6, 7, 8, 9, and 10. The four sets of cards of each deck can also be identified by different face signs to include a SPADE group set, a HEART group set, a CLUB group set, and a DIAMOND group set, such as the poker deck, or other four different kinds of sign. Whereby, the Spade group set is the highest face ranking group, and that the Heard group is the second in face ranking, and that the Club group is the third in face ranking, and that the Diamond group is the lowest in face ranking.

All the numbers on the numerical value cards represent their point value, for example a 7 SPADE card and a 7 DIAMOND card representing a point value of "7", a 10 CLUB card and a 10 HEART card representing a point value of "10", a 2 SPADE card and a 2 CLUB card representing a point value of "2". Also, the face cards (Jack, Queen, King) each represents a point value of "10". Furthermore, the Ace card also holds the point value of 10 points, but the point value of the Ace card can also be counted as "1" if desired or necessary at the time by the player.

To begin the card game, one of the players serves to shuffle the deck or decks of 52 cards and deals five cards to each player in the game in face down manner, wherein the cards can be dealt five at a time to each player or one at a time to each player until each player gets five cards. Each player carefully inspects the hand and then each player must select three cards from his hand of five cards to disclose by facing up while the other two unselected cards remain facing down in order to determine who can be qualified to process the card game. In order to be qualified to continue the card game, the three selected cards must reach a total sum of point value of ten, twenty or thirty by adding the point value of each selected cards together. If any player cannot successfully get three cards from the hand of five cards that has a total sum of ten, twenty or thirty, this player is disqualified and must leave the game and wait for the next round. Any player who can successfully select three cards from the hand of five cards that has a total sum of ten, twenty or thirty, this player is qualified to continue the game.

The following examples illustrate some qualified set of three selected qualifying cards.

K Club, Q Spade and J Spade, having a total sum of point value of thirty; or

K Spade, 7 Club and 3 Spade, having a total sum of point value of twenty; or

8 Spade, 7 Spade and 5 Diamond, having a total sum of point value of twenty; or

10 Club, 9 Club and Ace (counting as one), having a total sum of point value of twenty; or 2 Spade, 4 Club and 4 Diamond, having a total sum of point value of ten, etc.

However, if any player has a hand of five cards with any combination among the face cards, the numerical value card having the numerical value of 10 and the ACE, this hand of five cards is qualified as Big Ten combination, i.e. the total sum of point value of the five cards is fifty such as ACE, KING, QUEEN, JACK, and "10". Any player has a hand of Big Ten automatically win the game against the other players. Some typical Big Ten examples are illustrated as follows in ranking order.

ACE Spade, KING Spade, QUEEN Spade, JACK Spade, and 10 Spade (Royal Big Ten);

ACE Spade, KING Heart, QUEEN Club, JACK Diamond, and 10 Club (Straight Big Ten);

QUEEN Spade, QUEEN Heart, QUEEN Club, 10 Spade, and 10 Club (Full House Big Ten);

KING Spade, KING Heart, KING Club, KING Diamond, and QUEEN Club (Four Of Kind Big Ten);

ACE Heart, KING Diamond, JACK Spade, 10 Club, and 10 Club; or

JACK Spade, JACK Heart, JACK Diamond, KING Spade, and 10 Heart.

Wherein, any player who can get ACE, KING, QUEEN, JACK, and "10" of the same group set of face sign, such as Spade, Heart, Club, or Diamond, is called Royal Big Ten. Moreover, the Royal Big Ten has the highest ranking order than the Straight Big Ten which has a higher ranking order than the Full House Big Ten which has a higher ranking order than the Four Of Kind Big Ten.

If there is no player gets the Big Ten combination, all qualified players or the remaining qualified players who do not get the Big Ten combination should process the secondary stage. In the secondary stage, all qualified players disclose the two remaining unselected cards (named as playing cards) by facing up and comparing a comparison point value of the two playing cards of each player. The comparison point value is a total point value from ten to two simply achieved by adding the point values of the two playing cards if the sum of the point values of the two playing cards are less than or equal to ten. If the sum of the point values of the two playing cards is larger than ten, the total point value of the two playing cards is deducted by ten to achieve the comparison point value. The player who gets the highest comparison point value is the winner of this round of the card game.

The following are some typical examples illustrating how to calculate the comparison point value.

If a player gets two playing cards of 4 Club and 3 Spade, the comparison point value is "7".

If a player gets two playing cards of QUEEN Spade and ACE Spade, the total point value is "10" and the comparison point value is "10".

If a player gets two playing cards of 5 Club and 5 Spade, the comparison point value is the total point value, i.e. "10".

If a player gets two playing cards of KING Diamond and JACK Club, the total point value is "20" and the comparison point value is "10".

If a player gets two playing cards of ACE Heart and 9 Spade, the highest total point value is "20" and the comparison point value is "10".

If a player gets two playing cards of ACE Club and 8 Spade, the highest point value is "9" and the comparison point value is "9".

If two or more players get the same comparison point value, called "Tie Hand", the higher number (point value) card of the player's two playing cards is compared with the higher number (point value) card of the other player's two playing cards. The one having a higher numerical order wins the card game.

If the higher ranking card of two or more players are face cards, the ranking order of the face is compared. The one who gets the higher ranking order wins. The ACE has a high ranking order than the KING which has a higher ranking order than the QUEEN which has a higher ranking order than the JACK which has a higher ranking order than the "10".

If the higher number (point value) card of the two playing cards of each Tie Hand player has the same number (point value), the other playing card of each Tie Hand player is compared. The one having a higher numerical order in the other playing card wins the card game.

Alternatively, if the higher ranking card of the two playing cards of each of the two or more Tie Hand players has the same point value or is the same face card, the face sign of the higher ranking card of the two playing cards of each player is compared. The one who has the higher ranking face sign is the winner, wherein Spade has a higher order than Heart, which has higher order than Club, which has a higher order than Diamond.

EXAMPLE 1

Player 1: 8 Spade and ACE Club vs Player 2: 9 Club and KING Spade

Both the Player 1 and Player 2 have a comparison point value of "9", and then ACE Club of Player 1 is compared with KING Spade of Player 2. Although both ACE and KING has a point value of "10", however ACE has a higher ranking order than KING. Thus, Player 1 wins.

EXAMPLE 2

Player 1: 4 Club and 3 Spade vs Player 2: 5 Spade and 2 Club

Both the Player 1 and Player 2 have a comparison point value of "7". However, the point value of the higher number card of Player 1 is "4" which is smaller than the point value, i.e. "5" of the higher number card of Player 2, and thus Player 2 wins the card game.

EXAMPLE 3

Player 1: QUEEN Spade and ACE Spade vs Player 2: 5 Club and 5 Spade

Both the Player 1 and Player 2 have the comparison point value of "10". However, the higher point value card of the Player 1's two playing cards is ACE Spade which is in higher ranking order than the 5 Spade of the Player 2, and thus Player 1 wins the card game.

EXAMPLE 4

Player 1: 10 Spade and KING Club vs Player 2: 10 Club and KING Spade

Both Player 1 and Player 2 have the comparison point value of "10". However, the higher point value card of Player 1 is KING Club and the higher point value card of Player 2 is KING Spade. Even though both of them are KING, since Spade has a higher face sign order than Club, Player 2 wins the game.

The above disclosed card game can be further modified to have a House between two or among numerous of players. Before starting the Big Ten card game one of the players is entitled as a House who serves to shuffle and deal the cards. Moreover during the initial qualification stage, while the other players must disclose their three selected cards in order to be qualified to have the right to process the secondary stage, the House has to keep all his five card facing down. After all the other players have been qualified and remain their two playing card facing down, the House must also select three cards having a total point value of ten, twenty or thirty by summing up the point values of the three selected cards in order to be qualified to process the secondary comparison stage. If the House fails to show three cards having a total point value of ten twenty or thirty, the House is disqualified and all the qualified players will automatically win the game. If the House successfully selects three cards having a total point value of ten, twenty or thirty, the three selected cards of his five cards will be discarded and the House is qualified to enter the secondary comparison stage.

If a House is entitled as a role of the card game as mentioned above, in the secondary comparison stage, each qualified player is merely required to independently compare the comparison point value of his remaining playing cards with the House's two remaining playing card. If the House has a higher comparison point value, the House win the game. In the contrary, if any player gets a comparison point value higher comparison point value than that of the House, this player win the game. Of course, if a player can get a Big Ten combination as described above, he can automatically win the game against the House.

In order to enhance the excitement of the Big Ten card game, if any player can get a Big Ten combination, he should receive a higher award from the House, for example double the bonus. If any player can even get a Royal Big Ten combination, he should receive a highest award from the House, for example triple the bonus.

The above embodying description is provided to enable any person skilled in the art to make and use the invention and sets forth the best mode contemplated by the inventor of carrying out his invention. Various modifications, however, will remain readily apparent to those skilled in the art, since the generic principles of the present invention have been defined herein.

What is claimed is:

1. A method of playing a Big Ten card game, comprising the following steps:

(1) providing at least two players for said card game;

(2) providing at least a deck of 52 cards, wherein said deck of cards includes four sets of cards and each set of cards includes an ACE, three face cards including a JACK, a QUEEN, a KING, and nine numerical value cards including a 2 card, a 3 card, a 4 card, a 5 card, a 6 card, a 7 card, a 8 card, a 9 card, and a 10 card, a numerical value of each of said numerical value cards counting as a point value thereof, said ACE counting as a point value of either "1" or "10", each of said face cards counting as a point value of "0", and that said ACE has a higher ranking order than said KING, which has a higher ranking order than said QUEEN, which has a higher ranking order than said JACK, which has a higher ranking order than said numerical value card 10, (3) shuffling said deck of cards;

(4) dealing a hand of five cards to each of said players having all said hand of five cards facing down;

(5) determining and selecting three selected cards from said hand of five cards by each of said players to face up while the other two unselected cards remaining facing down to act as two playing cards, in which said three selected cards of each of said players must have a total point value of ten, twenty or thirty by summing up said point value of said three selected cards, in order to be qualified to continue said card game, on the other hand, said player who fails to select said three selected cards having a total point value of ten, twenty or thirty is disqualified to continue said card game;

(6) discarding said three selected cards from said hand of five cards and facing up said two playing cards by each of said qualified players;

(7) computing a comparison point value of said two playing cards of each of said qualified players, wherein said comparison point value is a total point value achieved by summing up said point values of said two playing cards when said total point value is equal to or less than ten, wherein said comparison point value is a total point value deducting with ten when said total point value is larger than ten; and (8) comparing said comparison point values of said qualified players with each other and determining which qualified player having a highest comparison point value to win said card game.

2. A method of playing a Big Ten card game, as recited in claim 1, in step (8), wherein when two or more qualified players have the same said comparison point value, one of said two playing cards which has a higher point value than the other playing card of each of said qualified players is selected as a higher ranking card to compare with each other in order to determine which of said qualified players win said card game.

3. A method of playing a Big Ten card game, as recited in claim 2, wherein when said higher ranking card of each of said two or more qualified players has a point value equal to ten, who of said qualified players has a higher ranking order than the other wins said card game.

4. A method of playing a Big Ten card game, as recited in claim 1, in step (4), wherein said player automatically wins said card game without further processing the remaining steps (5) to (8) when said player gets a Big Ten combination that a total sum of said five point values of said hand of five cards is equal to fifty.

5. A method of playing a Big Ten card game, as recited in claim 4, wherein said Big Ten combination is a straight Big Ten when said hand of five cards includes said ACE, said KING, said QUEEN, said JACK, and said 10 card.

6. A method of playing a Big Ten card game, as recited in claim 5, wherein said Big Ten combination is a Full House Big Ten when said hand of five cards includes two of said cards having a point value of ten in one kind and the other three of said cards are in another kind.

7. A method of playing a Big Ten card game, as recited in claim 6, wherein said Big Ten combination is a Four Of Kind Big Ten when said hand of five cards includes four of said cards in one kind.

8. A method of playing a Big Ten card game, as recited in claim 7, in step (2), wherein said four sets of cards of said deck is identified by four different face signs to include a Spade group set, which has a higher order than a Heart group set, which has a higher order than a Club group set, which has a higher order than a Diamond group set.

9. A method of playing a Big Ten card game, as recited in claim 8, in step (8), wherein when said higher ranking card of said two playing cards of each of said two or more qualified players has the same point value or the same face card, said face signs of said higher ranking cards are compared to determine which of said qualified players has a higher order than said other qualified players to win said card game.

10. A method of playing a Big Ten card game, comprising the following steps:

(1) providing a House and one or more players for said card game;

(2) providing at least a deck of 52 cards, wherein said deck of cards includes four sets of cards and each set of cards includes an ACE, three face cards including a JACK, a QUEEN, a KING, and nine numerical value cards including a 2 card, a 3 card, a 4 card, a 5 card, a 6 card, a 7 card, a 8 card, a 9 card, and a 10 card, a numerical value of each of said numerical value cards counting as a point value thereof, said ACE counting as a point value of either "1" or "10", each of said face cards counting as a point value of "10", and that said ACE has a higher ranking order than said KING, which has a higher ranking order than said QUEEN, which has a higher ranking order than said JACK, which has a higher ranking order than said numerical value card 10;

(3) shuffling said deck of cards;

(4) dealing a hand of five cards to said House and each of said players having all said hand of five cards facing down;

(5) determining and selecting three selected cards from said hand of five cards by each of said players to face up while the other two unselected cards remaining facing down to act as two playing cards, in which said three selected cards of each of said players must have a total point value of ten, twenty or thirty by summing up said point value of said three selected cards, in order to be qualified to continue said card game, on the other hand, said player who fails to select said three selected cards having a total point value of ten, twenty or thirty is disqualified to continue said card game;

(6) discarding said three selected cards from said hand of five cards and facing up said two playing cards by each of said qualified players;

(7) determining and selecting three selected cards from said hand of five cards by said House to face up while the other two unselected cards remaining facing down to act as two playing cards, in which said three selected cards of said House must also have a total point value of ten, twenty or thirty by summing up said point value of said three selected card, in order to be qualified to continue said card game, on the other hand, when said House fails to select said three selected cards having a total point value of ten, twenty or thirty, said House is disqualified to continue said card game and all said qualified players win said card game;

(8) computing a comparison point value of said two playing cards of each of said House and said qualified players, wherein said comparison point value is a total point value achieved by summing up said point values of said two playing cards when said total point value is equal to or less than ten, wherein said comparison point value is a total point value deducting with ten when said total point value is larger than ten; and (9) comparing said comparison point value of said House with said comparison point value of each of said qualified players respectively, wherein when said comparison point of said House is higher than that of said qualified player, said House wins said card game, and that when said comparison point of said qualified player is higher than that of said House, said qualified player wins said card game.

11. A method of playing a Big Ten card game, as recited in claim 10, in step (9), wherein when both said House and said respective qualified player have the same said comparison point value, one of said two playing cards which has a higher point value than the other playing card of each of said House and said respective qualified player is selected as a higher ranking card to compare with each other in order to determine a winner of said card game.

12. A method of playing a Big Ten card game, as recited in claim 11, wherein when said higher ranking card of each of said House and said respective qualified player has a point value equal to ten, who of said House and said respective qualified player has a higher ranking order than the other wins said card game.

13. A method of playing a Big Ten card game, as recited in claim 10, in step (4), wherein said player automatically wins said card game without further processing the remaining steps (5) to (9) when said player gets a Big Ten combination that a total sum of said five point values of said hand of five cards is equal to fifty.

14. A method of playing a Big Ten card game, as recited in claim 13, wherein said Big Ten combination is a straight Big Ten when said hand of five cards includes said ACE, said KING, said QUEEN, said JACK, and said 10 card.

15. A method of playing a Big Ten card game, as recited in claim 14, wherein said Big Ten combination is a Full House Big Ten when said hand of five cards includes two of said cards having a point value of ten in one kind and the other three of said cards are in another kind.

16. A method of playing a Big Ten card game, as recited in claim 15, wherein said Big Ten combination is a Four Of Kind Big Ten when said hand of five cards includes four of said cards in one kind.

17. A method of playing a Big Ten card game, as recited in claim 16, in step (2), wherein said four sets of cards of said deck is identified by four different face signs to include a Spade group set, which has a higher order than a Heart group set, which has a higher order than a Club group set, which has a higher order than a Diamond group set.

18. A method of playing a Big Ten card game, as recited in claim 17, in step (9), wherein when said higher ranking card of said two playing cards of each of said House and said respective qualified player has the same point value or the same face card, said face signs of said higher ranking cards are compared to determine which of said House and said respective qualified player has a higher order than another to win said card game.

* * * * *